US010731868B2

(12) United States Patent
Zecevic et al.

(10) Patent No.: US 10,731,868 B2
(45) Date of Patent: Aug. 4, 2020

(54) KITCHEN EXTRACTOR HOOD WITH DIRECTIONAL FLOW

(71) Applicant: B.S. SERVICE S.R.L., Fabriano (AN) (IT)

(72) Inventors: Nebojsa Neno Zecevic, Jesi (IT); Lorenzo Biagini, Fabriano (IT)

(73) Assignee: B.S. SERVICE S.R.L., Fabriano (AN) (IT)

( * ) Notice: Subject to any disclaimer, the term of this patent is extended or adjusted under 35 U.S.C. 154(b) by 67 days.

(21) Appl. No.: 16/310,538

(22) PCT Filed: Jul. 7, 2016

(86) PCT No.: PCT/IT2016/000170
§ 371 (c)(1),
(2) Date: Dec. 17, 2018

(87) PCT Pub. No.: WO2018/008045
PCT Pub. Date: Jan. 11, 2018

(65) Prior Publication Data

US 2019/0338959 A1 Nov. 7, 2019

(51) Int. Cl.
*F24C 15/20* (2006.01)

(52) U.S. Cl.
CPC ..... *F24C 15/2042* (2013.01)

(58) Field of Classification Search
CPC ..... B08B 15/02; B08B 15/002; B08B 15/00; B08B 15/023; B08B 2215/003; F24C 15/20
See application file for complete search history.

(56) References Cited

FOREIGN PATENT DOCUMENTS

| | | | |
|---|---|---|---|
| EP | 1227283 | A1 | 7/2002 |
| EP | 1887286 | A2 | 2/2008 |
| EP | 2196737 | A1 | 6/2010 |
| JP | H08334253 | A | 12/1996 |
| JP | 2001317785 | A | 11/2001 |
| WO | 2006001065 | A1 | 1/2006 |
| WO | 2007068751 | A2 | 6/2007 |
| WO | 2008148712 | A2 | 12/2008 |

OTHER PUBLICATIONS

International Search Report for PCT/IT2016/000170.
International Preliminary Report on Patentability for PCT/IT2016/000170.

*Primary Examiner* — Jason Lau
(74) *Attorney, Agent, or Firm* — Egbert, McDaniel & Swartz, PLLC

(57) ABSTRACT

Kitchen extractor hood with directional flow having a box body, an extractor fan with at least one inlet in communication with an internal chamber of the box body, a delivery fan with an inlet in communication with the internal chamber of the box body and a delivery outlet in communication with a delivery conduit, a distributor disposed at the end of the delivery conduit and deflector means disposed above the distributor in such a way to direct a delivery airflow from the delivery conduit towards at least one preferential direction with respect to the axis of the distributor, in such a way that at least two airflows with different flow rate come out from the distributor, wherein the airflow with the higher flow rate is directed towards a burner of the cooktop having a higher power than the other burners.

11 Claims, 12 Drawing Sheets

KITCHEN EXTRACTOR HOOD WITH DIRECTIONAL FLOW

The present patent application for industrial invention relates to a kitchen extractor hood with directional flow.

Generally, an extractor hood comprises a box body that houses a fan actuated by an electrical motor, which creates a depression in the box body in such a way to extract the fumes rising from a cooktop. In order to ensure that all fumes rising from the cooktop are conveyed inside the box body of the hood, the box body must be very large and the electrical motor of the fan must be very powerful. Therefore, such a hood is impaired by the large volume of the hood body and by the noise of the fan motor.

Said drawbacks are solved in WO2008148712, which discloses an extractor hood comprising an extraction conduit and one or more delivery conduits disposed in such a way to generate air flows faced towards the cooktop that make air extraction from the extraction conduit of the hood easier.

WO2008148712 discloses an embodiment wherein the extraction conduit is disposed coaxially inside the delivery conduit. A deflector is disposed inside the delivery conduit comprising an annular distributor provided with a plurality of blades. Each blade of the distributor is disposed according to an axis inclined by an angle, different from zero, with respect to the radial axis passing through the blade and the center of the distributor. In this way the distributor generates a vortex-shaped airflow with helicoidal profile around the airflow extracted by the hood. Such a vortex-shaped airflow acts as pneumatic screen in such a way to convey the fumes extracted from the cooktop inside the pneumatic screen generated by the distributor.

However, it must be considered that cooktops generally have a plurality of burners, with one burner that is more powerful than the other burners. Therefore a higher quantity of fumes is generated above the most powerful burner.

The pneumatic screen generated by the distributor disclosed in WO2008148712 has a substantially constant intensity all around the cooktop. Therefore such a pneumatic screen has a sufficient intensity to screen the fumes coming from low-power burners, but it could be inadequate to screen the fumes coming from high-power burners. Consequently, in the case of high-power burners, it is necessary to over-dimension the power of the motor of the fan used to feed air in the delivery conduit, thus generating excessive noise.

WO2008148712 discloses other embodiments of extractor hoods wherein the delivery conduits are not provided with deflectors to generate a vortex and are not devised in such a way to consider the use of burners with different power.

The purpose of the present invention is to eliminate the drawbacks of the prior art by devising a kitchen extractor hood that is effective and efficacious in extracting fumes, also in case of cooktops provided with low-power burners and high-power burners.

Another purpose of the present invention is to provide such an extractor hood that is not cumbersome and is noiseless.

These purposes are achieved according to the invention with the characteristics of the independent claim 1.

Advantageous embodiments appear from the dependent claims.

The extractor hood of the invention comprises:

a box body having a base portion intended to be disposed above a cooktop; said box body defining an internal chamber, an extractor fan with at least one inlet in communication with said internal chamber of the box body, in such a way to create a depression in the internal chamber of the box body to extract fumes from the cooktop through an opening of said base portion of the box body, a delivery fan with one inlet in communication with said internal chamber of the box body and an outlet in communication with a delivery conduit having one end disposed in said base portion of the box body, before said opening of the base portion of the box body through which the fumes are extracted, a distributor disposed at the end of said delivery conduit; said distributor comprising an annular body with an internal surface with truncated-conical shape having an axis that coincides with the axis of the distributor, and deflector means disposed above said distributor in such a way to direct an airflow from said delivery conduit towards at least one preferential direction with respect to the axis of the distributor, in such a way that at least two airflows with different flow rate come out from the distributor, wherein the airflow with the higher flow rate is directed towards a burner of said cooktop having a higher power than the other burners.

The advantages of the extractor hood of the invention are evident. The combination between the distributor and the deflector means allows having at least two airflows with different flow rate coming from the distributor. In this way the airflow with the highest flow rate can be directed towards the most powerful burner in order to optimize fume extraction.

Additional features of the invention will appear clearer from the detailed description below, which refers to merely illustrative, not limiting embodiments, wherein.

Figure 7:
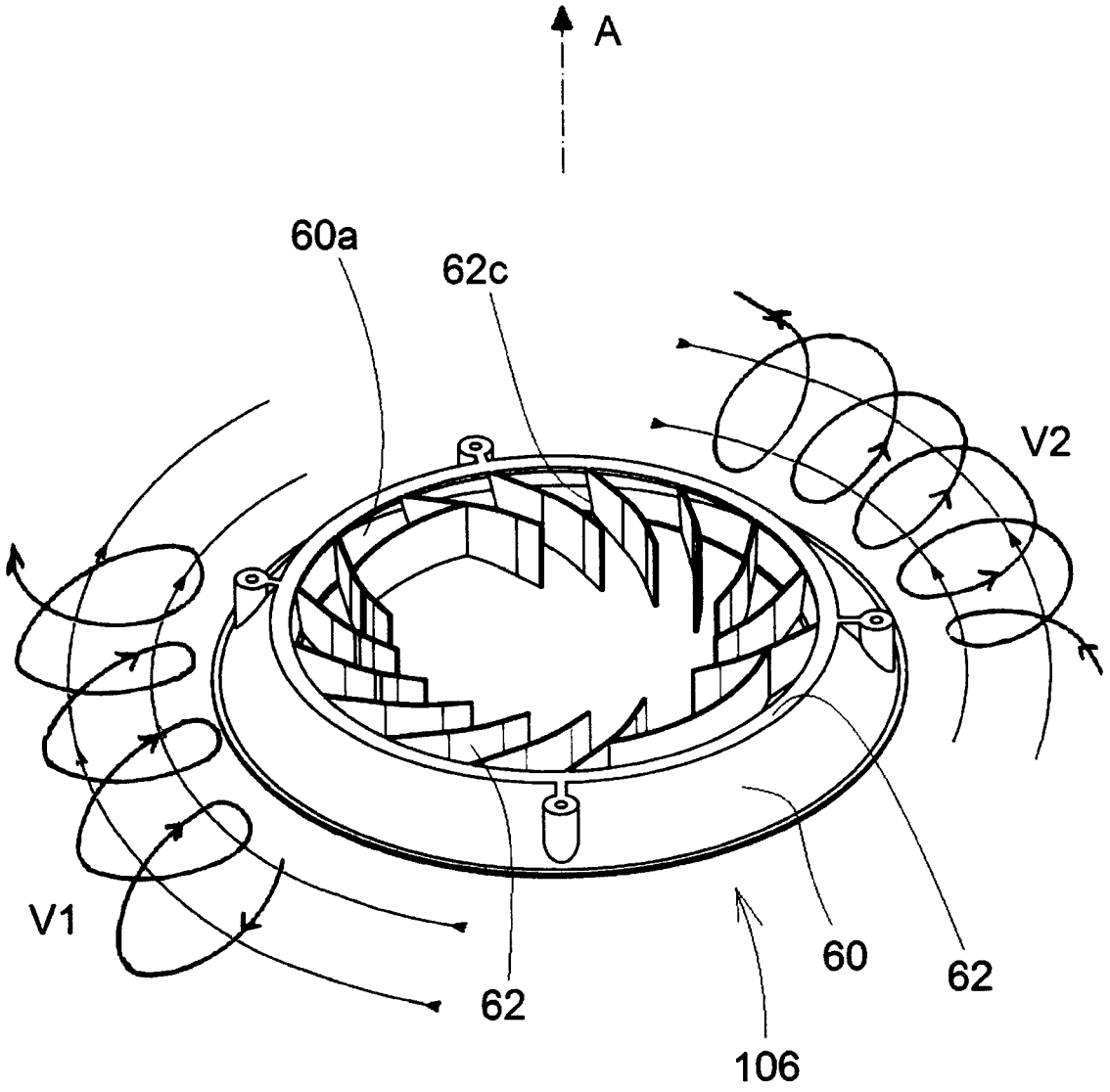
FIG. 7 is a perspective view of a second embodiment of the distributor of the extractor hood of FIG. 1.
Figure 12:
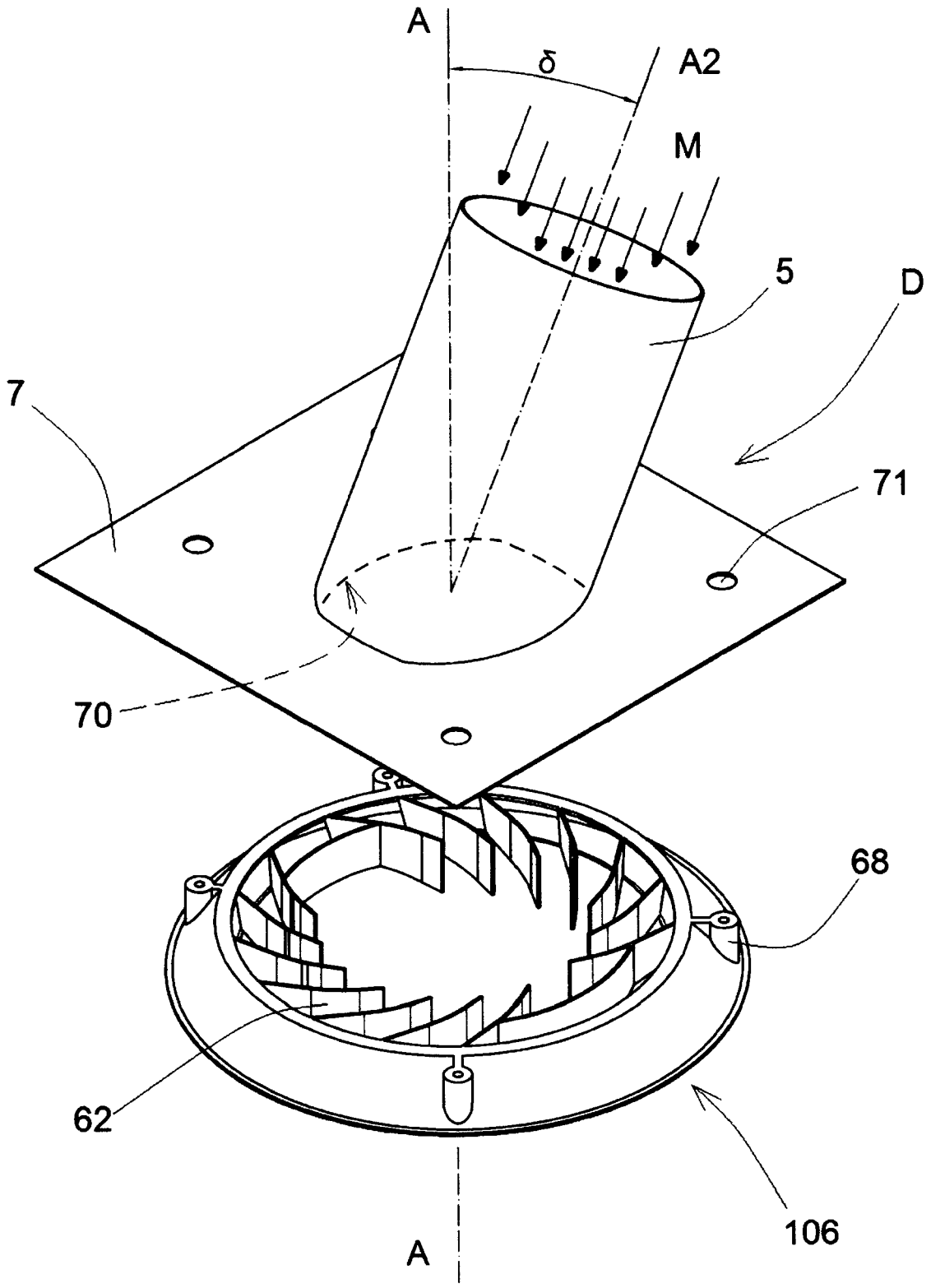
Figure 13:
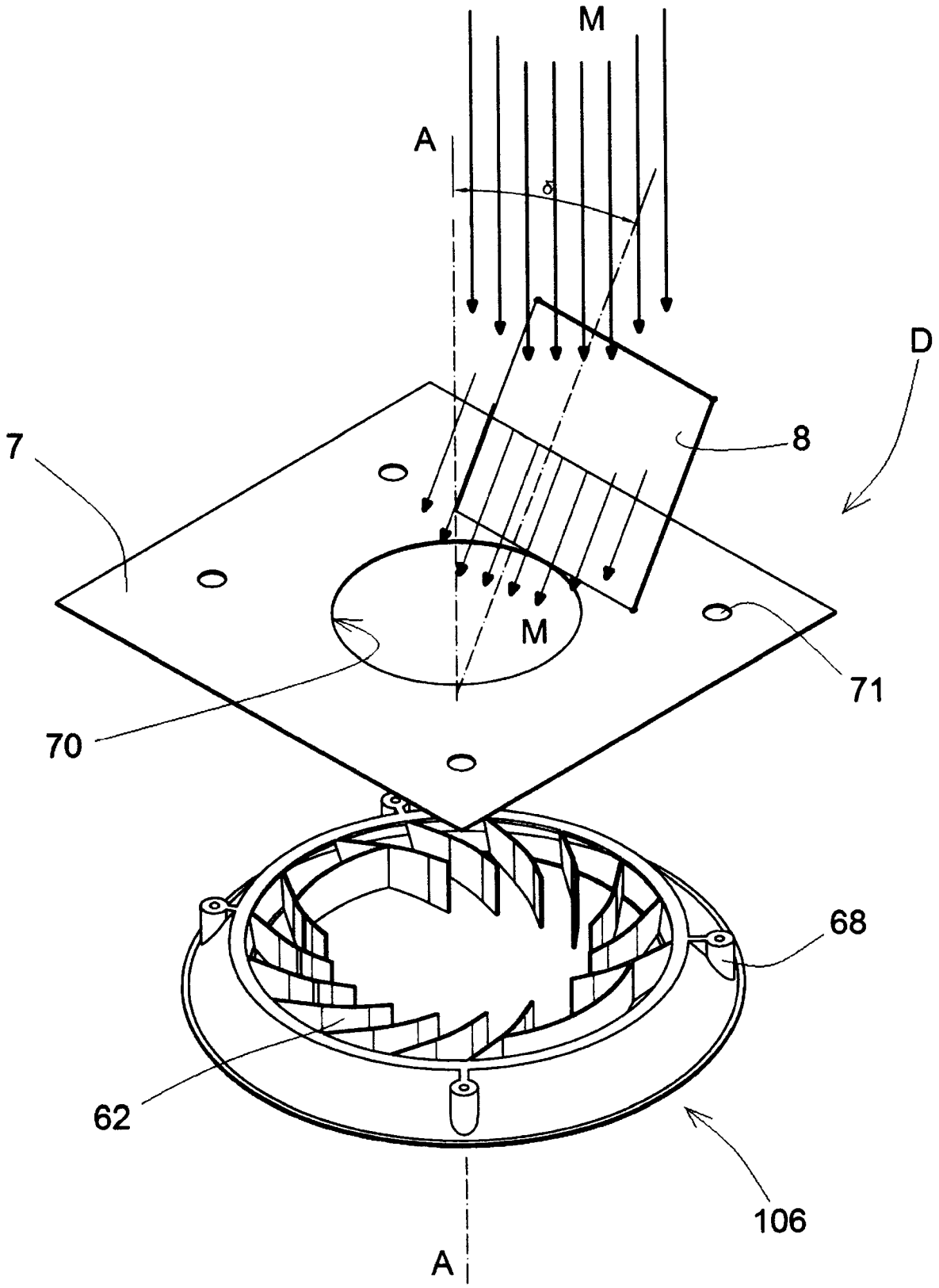

FIG. 12 is an exploded perspective view of the distributor of FIG. 7 and a second embodiment of the deflector means comprising a flange with central hole to which a delivery conduit with inclined axis is applied; and FIG. 13 is an exploded perspective view of the distributor of FIG. 7 and a third embodiment of the deflector means comprising a flange with central hole to which a plate deflector is applied.

With reference to the Figures, the extractor hood is disclosed according to the invention, which is generally indicated with reference numeral 100.

With reference to FIGS. 1-4, the extractor hood (100) is intended to be disposed above a cooktop (T) comprising a plurality of burners (B1, B2, B3, B4) on which cooking vessels (C1, C4) are placed. Two cooking vessels are shown for illustrative purposes: a smaller cooking vessel (C1) disposed on the less powerful burner (B1) and a larger cooking vessel (C4) disposed on the more powerful burner (B4). Consequently, a higher quantity of fumes will be produced above the largest vessel (C4).

The extractor hood (100) comprises a box body (1) with substantially parallepiped shape that defines an internal chamber (18). The box body (1) has a base portion (10) that protrudes outwards with respect to the box body in such a way to be disposed above the cooktop (T). The box body (1) is fixed to a masonry wall (W).

An extractor fan (2) is mounted inside the internal chamber (18) of the box body (1). Preferably, the extractor fan (2) is disposed under an upper wall (12) of the box body in central position. The extractor fan (2) is actuated by an electrical motor (20). The extractor fan comprises two inlets (21, 22) and one outlet (23). The inlets (21, 22) of the extractor fan are in communication with the internal chamber (18) of the box body (1). The outlet (23) of the extractor fan is in communication with a suction conduit (4) that comes out from the box body, crossing the upper wall (12) of the box body.

In case of an extractor hood with filtering function only, the suction conduit (4) is not provided and the outlet (23) of the extractor fan discharges in the box body (1) of the extractor hood.

The base portion (10) of the box body (1) of the extractor hood is open on the bottom and is provided with an opening (11) in communication with the internal chamber (18) of the box body through which the air can pass. The opening (11) of the base portion of the extractor hood is covered by filters (of known type and not shown in the figures) intended to let the air pass and filter impurities, such as fats and fumes.

In this way, the extractor fan (2) creates a depression inside the box body (1) and the fumes (F) coming from the cooking vessels (C1, C4) are extracted inside the box body (1) and conveyed from the extractor fan (2) towards the suction conduit (4).

A delivery fan (3) is mounted inside the internal chamber (18) of the box body (1). Preferably, the delivery fan (3) is disposed behind a front wall (13) of the box body in central position under the extractor fan (2). The delivery fan (3) is actuated by an electrical motor (30). The delivery fan comprises one inlet (31) and one outlet (33). The inlet (31) of the delivery fan (2) is in communication with the internal chamber (18) of the box body (1). The outlet (33) of the delivery fan is in communication with a delivery conduit (5) that extends inside the internal chamber (18) of the box body (1) under the delivery fan (3). The delivery conduit (5) has a lower end (50) in correspondence of the base (10) of the extractor hood.

A distributor or diffuser (6) is mounted at the lower end (50) of the delivery conduit in order to let the air come out from the delivery conduit. The distributor (D) has an axis (A).

Deflector means (D) are disposed above the distributor (6) in such a way to direct a delivery airflow (M) from said delivery conduit (5) towards a preferential direction with respect to the axis (A) of the distributor. In view of the above, two airflows (V', V") with different flow rate come out from the distributor (6). The airflow with higher flow rate (V") is directed towards the more powerful burner (B4).

Advantageously, the distributor (6) is suitable for generating at least one vortex-shaped airflow (V), that is to say an airflow with helical direction that rotates around a vertical axis that coincides with the axis of the distributor. By acting on the vortex-shaped airflow, the deflector means (D) generate two vortex-shaped airflows (V', V") with different flow rate that rotate in the same direction.

The vortex-shaped airflows (V', V") effectively push the fumes (F) rising from the cooking vessels towards the opening (11) of the box body, allowing the extractor hood to perform a more complete and more effective extraction. In particular, the vortex-shaped airflow (V") with higher flow rate has a stronger pushing action on the fumes rising from the cooking vessel (C4) disposed on the most powerful burner (B4).

Moreover, such an arrangement with the delivery fan (3) mounted inside the box body (1) allows to increase the extraction efficiency of the fumes (F) from the cooktop. In fact, fumes extraction is performed both by the extractor fan (2) and by the delivery fan (3), making it possible to underdimension the two fans (2, 3) and minimize the noise of the fans.

Figure 1:
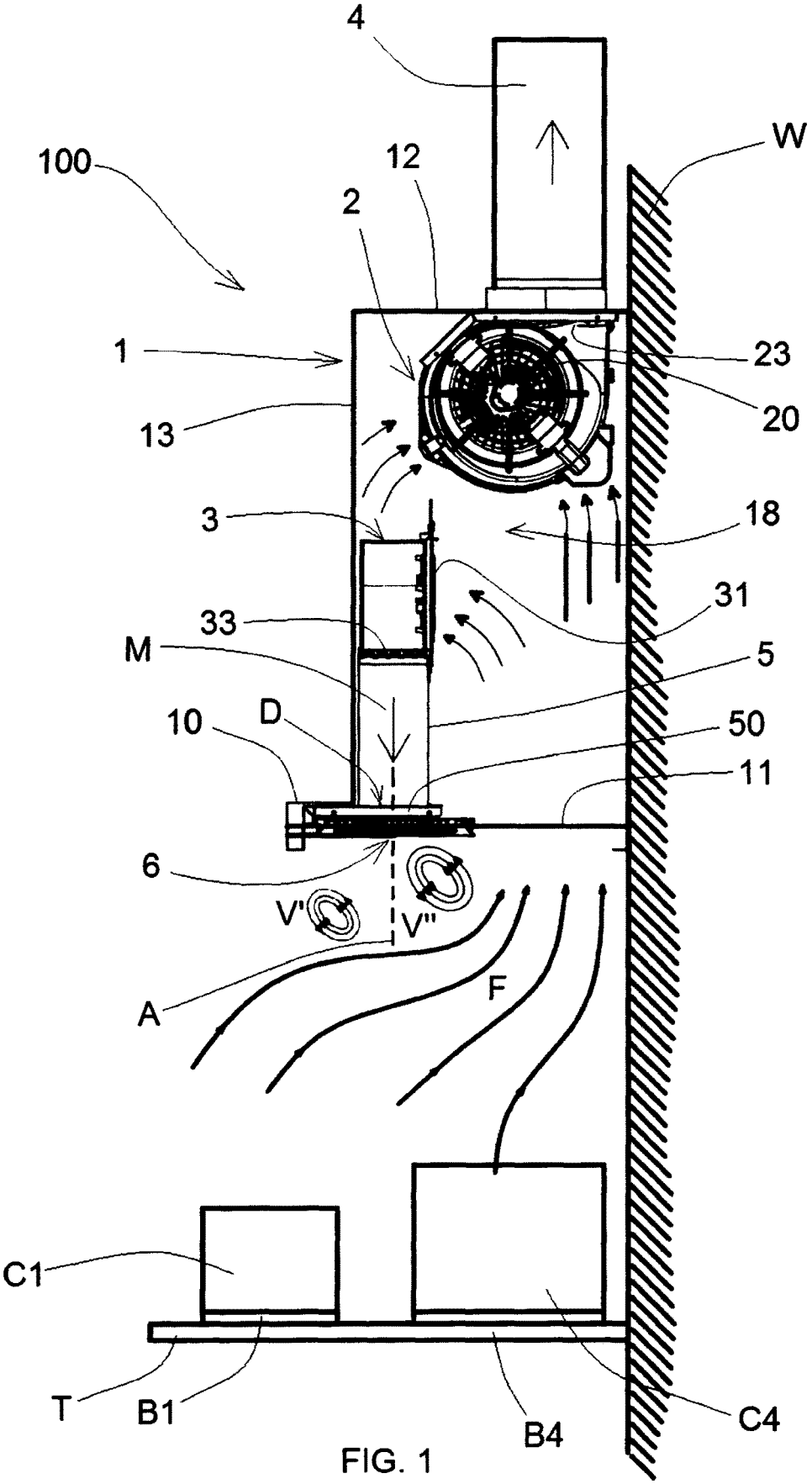
FIG. 1 is a side view of the extractor hood of the invention.
Figure 2:
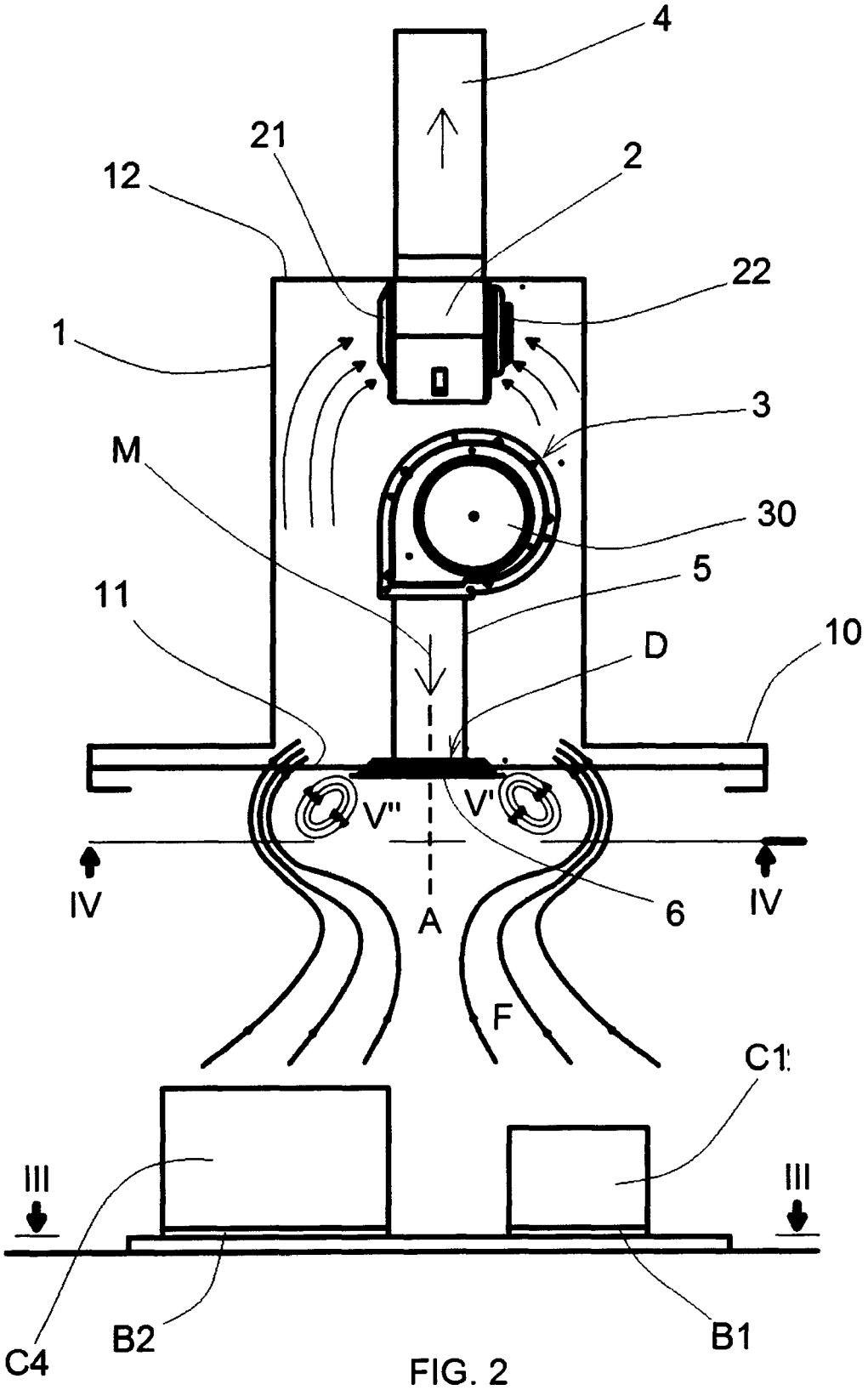
FIG. 2 is a front view of the extractor hood of the invention.
Figure 3:
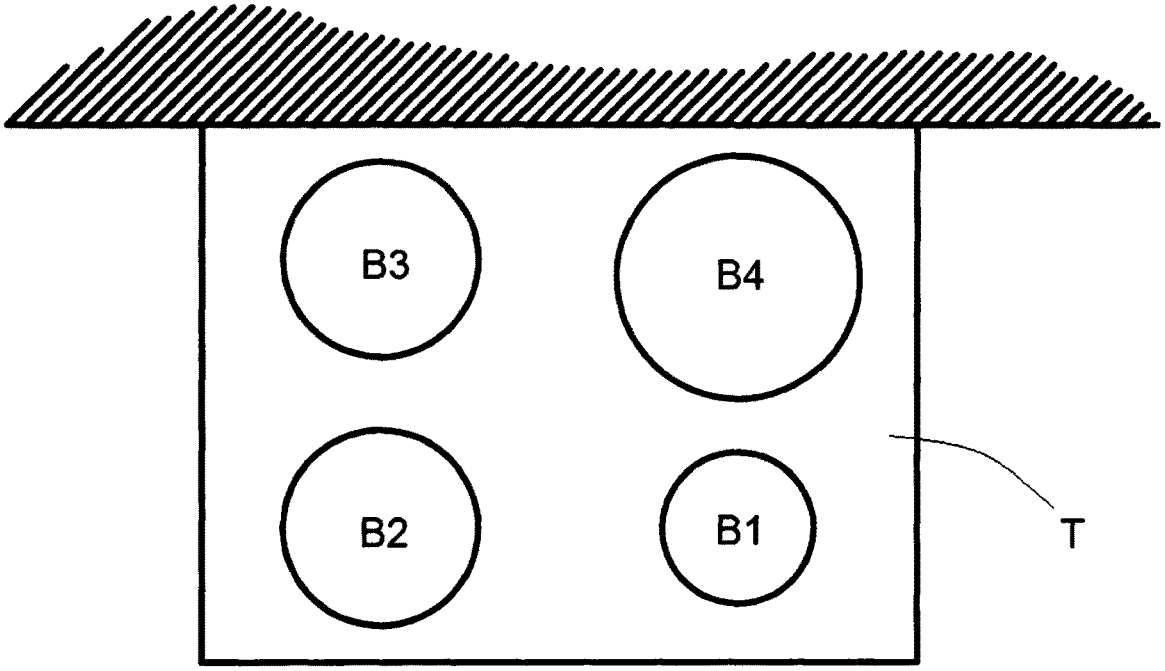
FIG. 3 is a top view of the cooktop taken along the plane III-Ill of FIG. 2.
Figure 4:
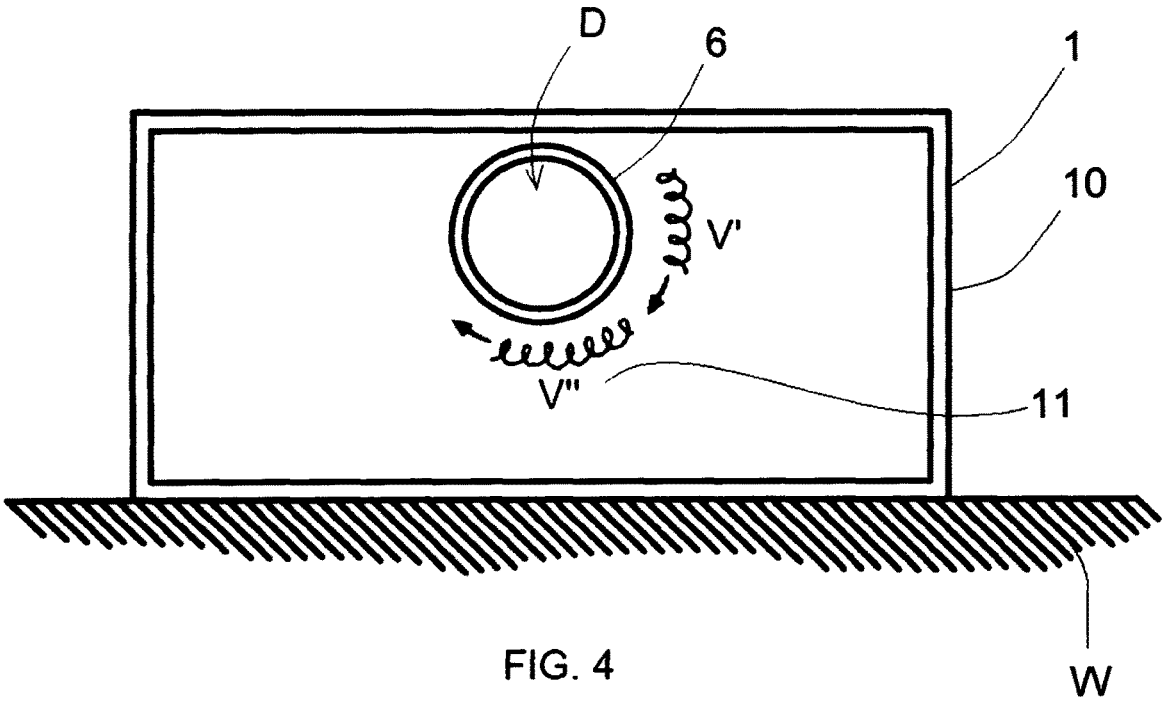
FIG. 4 is a bottom view of the extractor hood taken along the plane IV-IV of FIG. 2.
Figure 5:
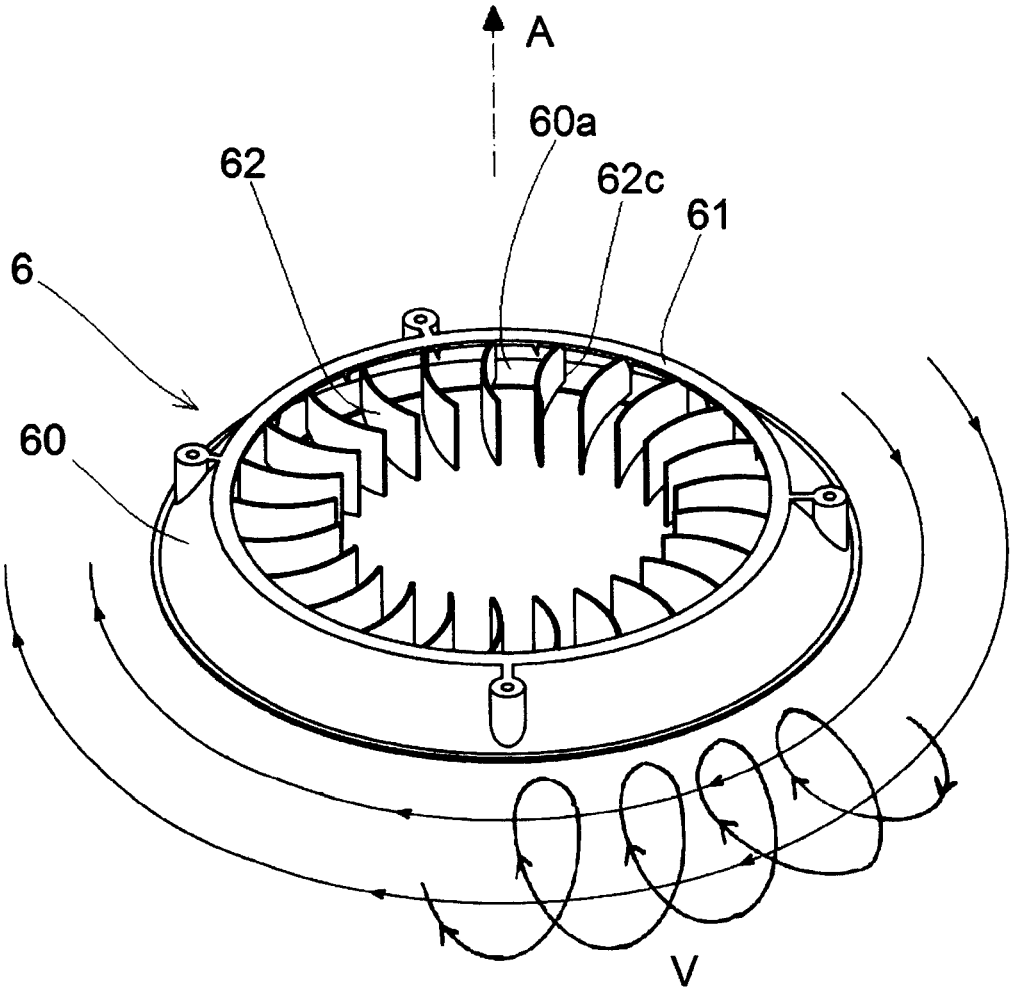
FIG. 5 is a perspective view of a distributor of the extractor hood of FIG. 1.
Figure 6:
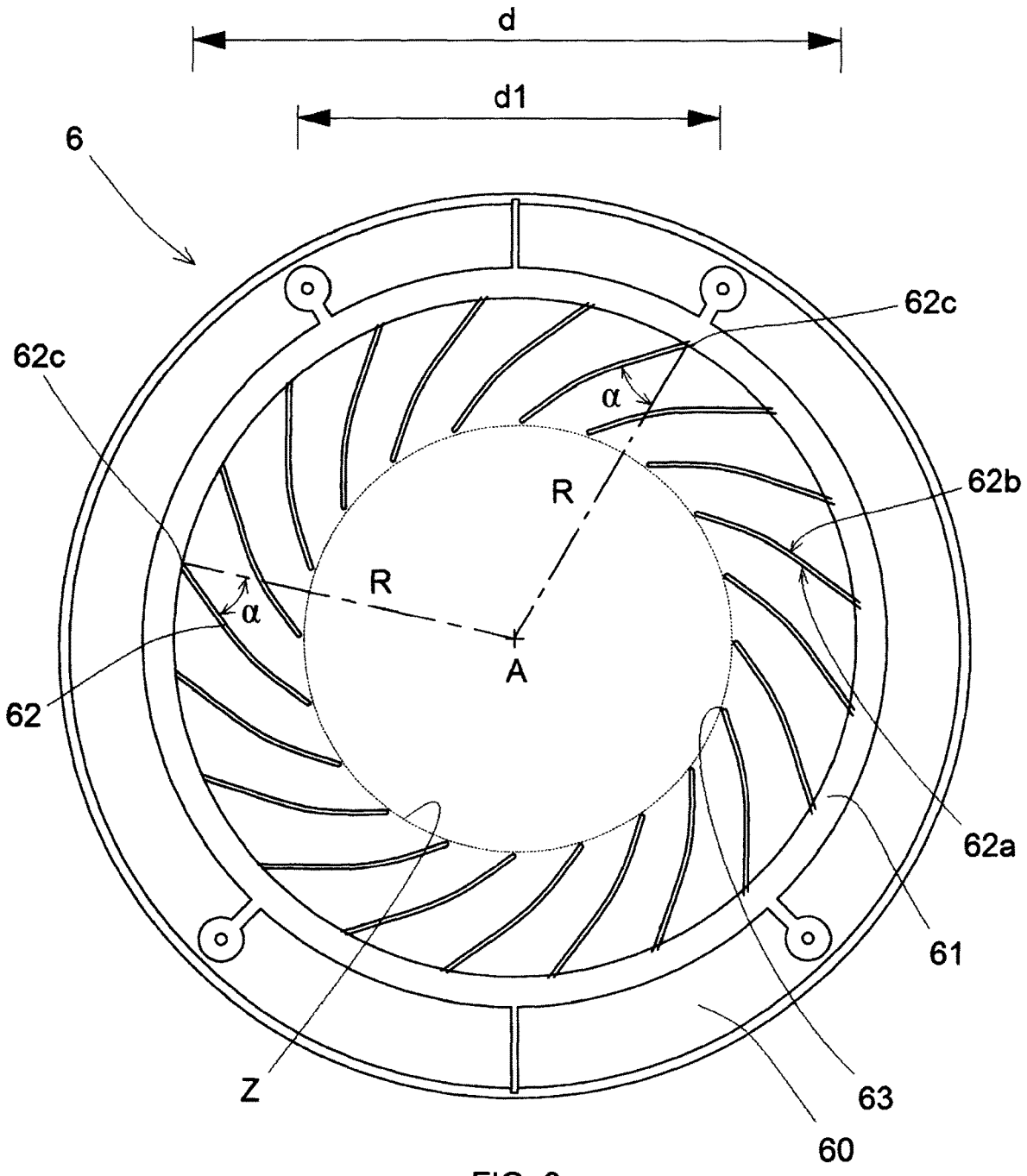
FIG. 6 is a top view of the distributor of FIG. 5.

With reference to FIGS. 5 and 6, the distributor (6) according to a first embodiment comprises an annular body (60). The annular body (60) has an internal surface (60*a*) with truncated-conical shape having an axis that coincides with the axis (A) of the distributor. The annular body (60) has an upper border (61) with internal diameter (d).

A plurality of deflector fins (62) protrude towards the inside of the internal surface (60*a*) of the annular body. The deflector fins (62) are connected to the internal surface (60*a*) of the annular body along junction lines (62*c*). Each deflector fin (62) is curved and provided with a concave part (62*a*) and a convex part (62*b*).

Each deflector fin (62) is not disposed radially, but it is inclined by an angle (α) with respect to a radial straight line (R) passing through the axis (A) of the distributor and the junction line (62*c*) of the fin. The angle (α) extends in clockwise direction from the radial straight line (R) towards the deflector fin (62). The angle (α) may vary from 20° to 70°, but is preferably comprised between 40° and 50°.

Each deflector fin (62) has a length comprised between ¼ and ⅓ of the internal diameter (d) of the upper border. In this way, the ending edges (63) of each fin are disposed on a circumference (Z) (shown with a broken line) with diameter (d1) and center passing through the axis (A) of the distributor. The diameter (d1) of the circumference (Z) is approximately ½-¾ of the diameter (d) of the upper border (61) of the distributor.

The deflector fins (62) are equally spaced. All deflector fins have the same shape and the same inclination with respect to the radial straight line (R). With such a configuration of the deflector fins of the distributor, without the deflector means, only one vortex (V) (see FIG. 5) would be obtained, which would come out from the bottom of the distributor (6) and would rotate in clockwise direction around the axis (A) of the distributor along a helicolidal trajectory. The deflector means (D) contribute to form two vortexes (V', V") with different flow rate.

Figure 8:
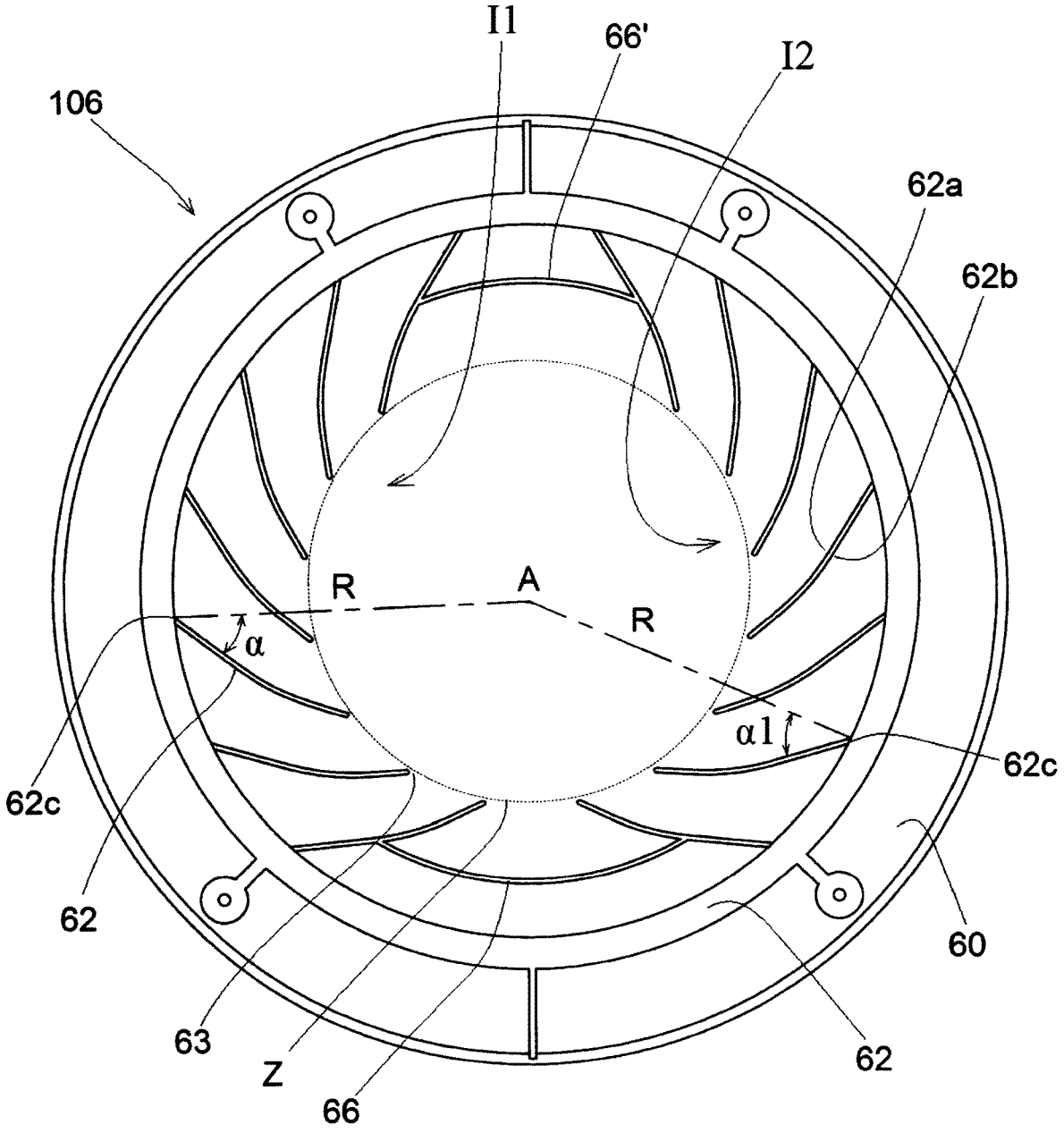
FIG. 8 is a top view of the distributor of FIG. 7.

With reference to FIGS. 7 and 8, a distributor (106) according to a second embodiment is disclosed. The distributor (106) is perfectly interchangeable with the distributor (6) and can be applied in the extractor hood (100) instead of the distributor (6).

The distributor (106) comprises:

a first set (11) of deflector fins (62) that extend for half of the distributor circumference, that is to say for approximately 180°; and a second set (11) of deflector fins (62) disposed symmetrically to the deflector fins of the first set (11) with respect to the distributor diameter.

In view of the above, each deflector fin (62) of the second set (12) is inclined by an angle ($\alpha 1$) with respect to a radial straight line (R) passing through the axis (A) of the distributor and the junction line (62*c*) of the fin. The inclination angle ($\alpha 1$) of the fins of the second set (12) is identical to the angle ($\alpha$) of inclination of the fins of the first set (11). However, in this case, the inclination angle ($\alpha 1$) of the fins of the second set (I2) extends in anticlockwise direction from the radial straight line (R) towards the concave part (62*a*) of the deflector fin.

A first connection fin (66) connects the first fin of the first set (I1) with the last fin of the second set (I2).

A second connection fin (66') connects the last fin of the first set (I1) with the first fin of the second set (I2).

The connection fins (66, 66') are disposed in diametrally opposite positions with respect to the axis (A) of the distributor (106). The connection fins (66, 66') are curved with concavity facing towards the axis of the distributor and centre of curvature that coincides with the axis (A) of the distributor.

With such a configuration of the two sets of deflector fins of the distributor (106), without the deflector means (D), two vortexes (V1, V2) (see FIG. 7) would be obtained, which would come out from the bottom of the distributor (106). The first vortex (V1) rotates in clockwise direction around the axis (A) of the distributor along a helicoidal trajectory. The second vortex (V2) rotates in anticlockwise direction around the axis (A) of the distributor along a helicoidal trajectory.

If the deflector means (D) direct the airflow (M) from the delivery conduit (5) towards the second set (I2) of deflector fins, the second vortex (V2) will have a higher flow rate than the first vortex (V1). In such a case, the distributor (106) is disposed in the extractor hood (100) in such a way to direct the second vortex (V2) towards the more powerful burner (B4).

Figure 9:
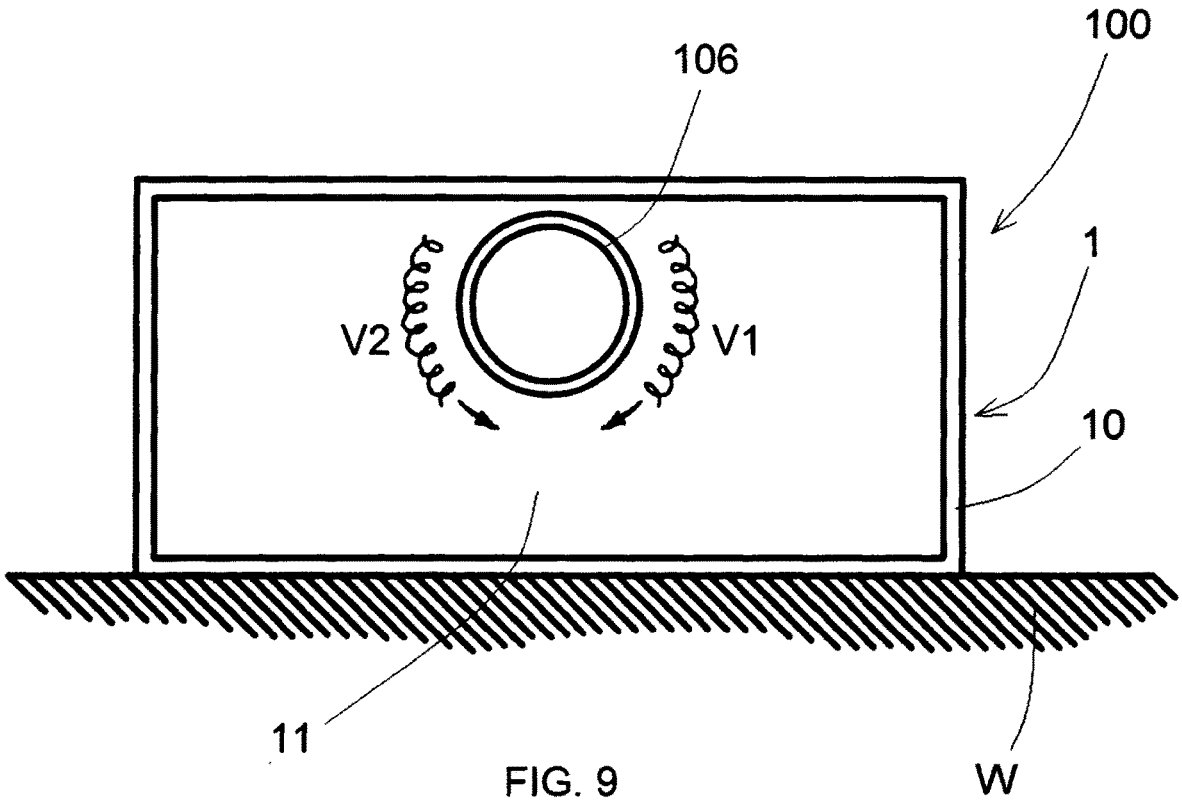
FIG. 9 is a bottom view of the extractor hood according to the invention with the distributor of FIG. 7.

With reference to FIG. 9, the distributor (106) is mounted in the hood (100) in such a way that the two vortexes (V1, V2) meet in a position of the opening (11) of the box body of the hood disposed behind the distributor (106). In this way, the vortexes (V1, V2) coming out from the distributor hit the fumes coming from the cooktop (T) from opposite positions, in such a way to compress and convey them efficiently towards the opening (11) of the box body of the hood disposed behind the distributor (106).

Figure 10:
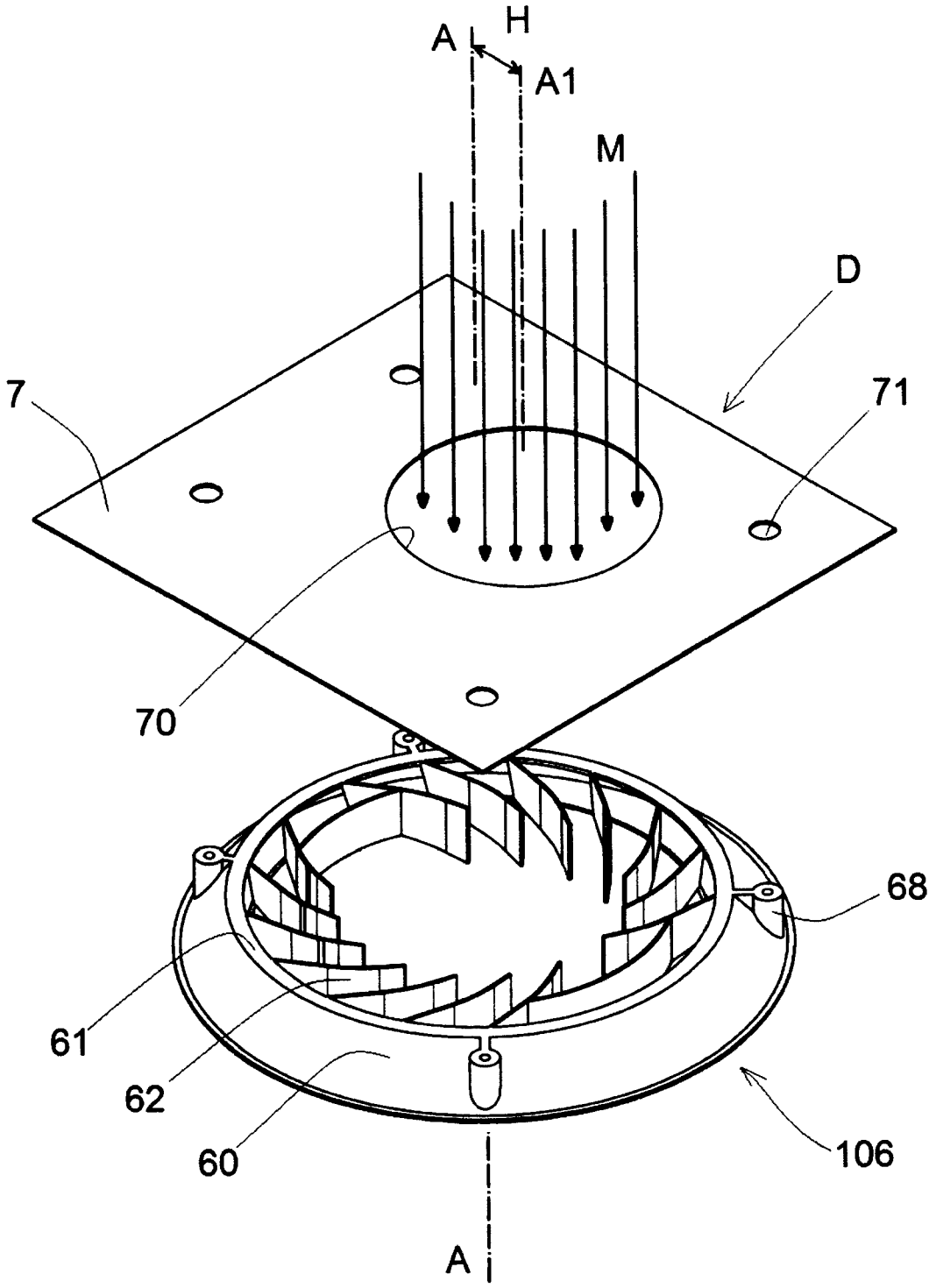
FIG. 10 is an exploded perspective view of the distributor of FIG. 7 and a first embodiment of deflector means comprising a flange with eccentric circular hole.

With reference to FIG. 10, the deflector means (D) comprise a flange (7) mounted on the distributor (106). The flange (7) is shaped as a plate with an eccentric hole (70) for the passage of the delivery air (M) sent from the delivery conduit (5). The flange (7) is disposed on the upper border (61) of the distributor. The eccentric hole (70) of the flange can be circular with a diameter that is identical to or lower than the diameter (d1) of the circumference (Z) passing by the ending edges (63) of the deflector fins.

The eccentric hole (70) of the flange has an axis (A1) parallel to the axis (A) of the distributor and spaced from the axis (A) of the distributor by a spacing distance (H).

If the axis (A1) of the eccentric hole of the flange is closer to the deflector fins (63) of the second set (12), a higher air rate will be present on the deflector fins of the second set (12), and therefore the second vortex (V2) will have a higher rate than the first vortex (V1). Consequently, the distributor (106) is mounted in the delivery conduit (5), in such a way that the second vortex (V2) (the more powerful vortex) is directed towards the burner (B4) (the more powerful burner).

The flange (7) has fixing holes (71) to receive fixing means, such as screws, that are engaged in shanks (68) provided in the annular body (60) of the distributor.

Figure 11:
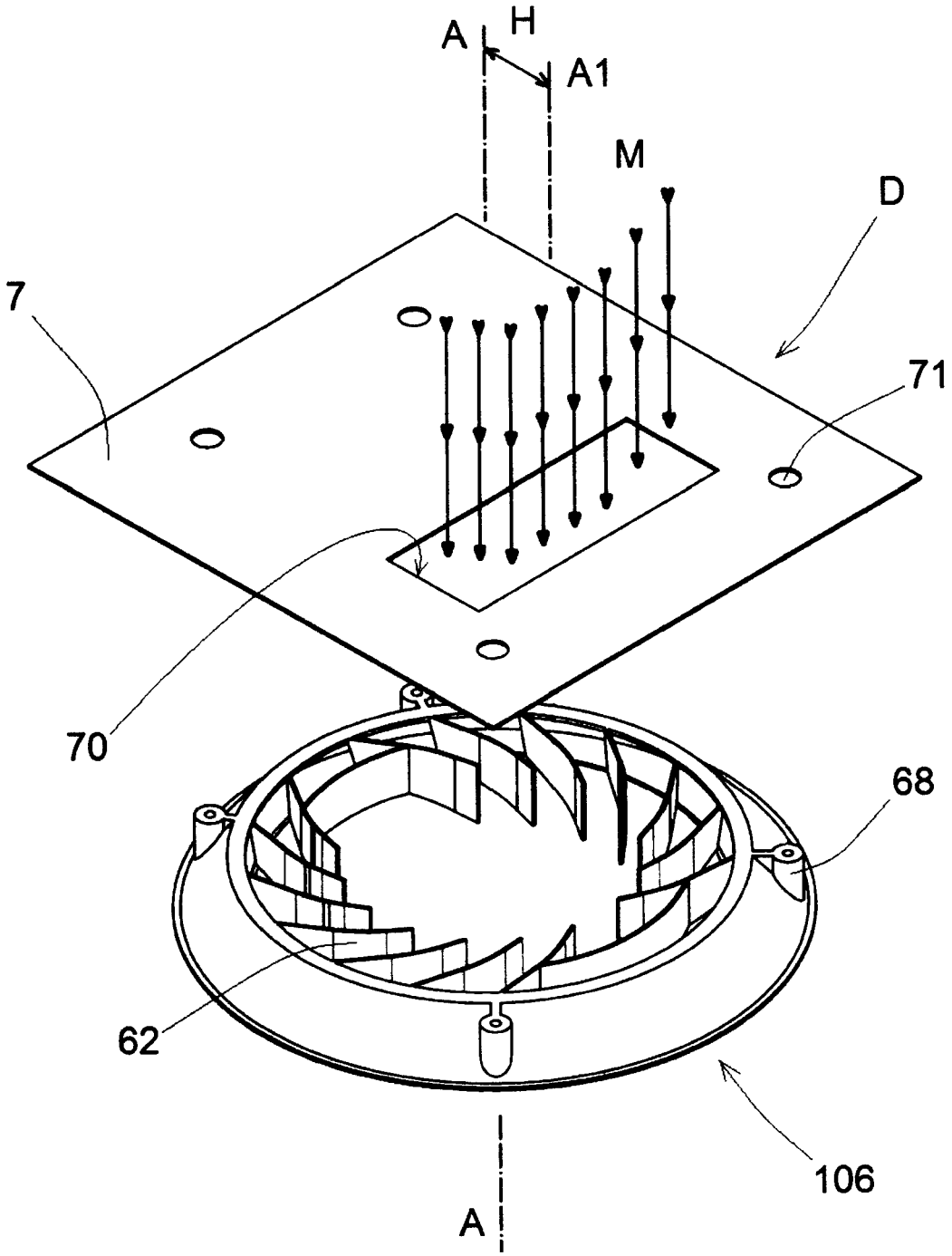
FIG. 11 is an exploded perspective view of the distributor of FIG. 7 and a variant of the deflector means comprising a flange with eccentric rectangular hole.

The flange (7) can be also mounted on the distributor (6) of the first embodiment of FIGS. 5 and 6. In such a case, as shown in FIG. 11, two vortexes (V', V") are generated, both rotating in clockwise direction around the axis (A) of the distributor. However, if the vortex (V") is closer to the axis (A1) of the eccentric hole (70) of the flange, the vortex (V") has a higher flow rate than then vortex (V'). Therefore, the flange (7) is disposed in such a way that the axis (A1) of the hole of the flange is closer to the more powerful burner with respect to the axis (A) of the distributor.

FIG. 11 shows a variant of the deflector means (D), wherein the eccentric hole (70) of the flange has a rectangular shape. The axis (A1) passing through the center of the rectangular hole is parallel to the axis (A) of the distributor and is spaced by a spacing distance (H) with respect to the axis (A) of the distributor.

Evidently, the eccentric hole (70) of the flange can have any shape, such as a slot-shape or a curved shape; in any case, the hole (70) of the flange must be an eccentric hole with respect to the axis of the distributor, in such a way to obtain a more powerful airflow directed towards the axis (A1) of the eccentric hole of the flange.

In any case, the delivery conduit (5) is arranged on the flange (7) above the eccentric hole (70) of the flange.

FIG. 12 shows a second embodiment of the deflector means (D). In such an embodiment of FIG. 12, the flange (70) has a central hole (170) with a center on the axis (A) of the distributor. However, in such a case, the delivery conduit (5) has an axis (A2) inclined by an angle (8) with respect to the axis (A) of the distributor. The angle (8) can vary from 10° to 50°, preferably between 25° and 35°. In such a way, the delivery airflow (M) is directed towards a preferential part of the distributor (106), for example towards the second set (12) of the deflector fins. As a result, a vortex flow (V2) with higher intensity in a preferential direction will come out from the distributor (106).

FIG. 13 shows a third embodiment of the deflector means (D), wherein the flange (7) has a central hole (170) disposed on the axis (A) of the distributor. In such a case, the deflector means (D) also comprise a deflector (8) shaped as a plate. The deflector (8) is mounted on the flange (7) in proximity to the central hole (170). The deflector (8) is disposed along a plane inclined by an angle (6) with respect to the axis (A) of the distributor. The angle (6) can vary from 10° to 50°, preferably between 25° and 35°. In such a way the delivery airflow (M) coming from the delivery conduit hits the deflector (8) and is directed towards a preferential wall of the distributor (106). As a result, a vortex flow (V2) with higher intensity in a preferential direction will come out from the distributor (106).

The delivery conduit (5) is disposed on the flange (7) above the central hole (70), in such a way that the deflector (8) is disposed inside the delivery conduit (5).

Although in FIGS. 12, 13 and 14 the distributor (106) is shown with two sets (11, 12) of fins that form two vortex-shaped airflows in opposite directions, evidently the distributor (6) can be used instead of the distributor (106) with a single set of fins that generates a vortex-shaped airflow that rotates in one direction. In fact, in any case, the deflector means (D) contribute to change the delivery airflow (M) in such a way to obtain at least two vortexes (V', V") with different air rate from the distributor (6), which will be directed in different directions according to the power of the burners.

Although the figures show deflector means (D) that direct the delivery airflow (M) in a single preferential direction with respect to the axis (A) of the distributor, the deflector means (D) may comprise a flange with a plurality of holes for air passage or a plurality of delivery conduits (5) with different inclination or a plurality of plate-shaped deflectors (8) disposed in different positions. In such cases, the deflector means (D) would direct the delivery airflow (M) in multiple preferential dimensions with respect to the axis (A) of the distributor, thus generating more than two airflows from the distributor that may directed towards burners with different power.

Numerous variations and modifications can be made to the present embodiments of the invention, which are within the reach of an expert of the field, falling in any case within the scope of the invention as disclosed by the attached claims.

The invention claimed is:

1. Extractor hood comprising:

a box body having a base portion intended to be disposed above a cooktop; said box body defining an internal chamber, an extractor fan with at least one inlet in communication with said internal chamber of the box body, in such a way to create a depression in the internal chamber of the box body to extract fumes from the cooktop through an opening of said base portion of the box body, a delivery fan with one inlet in communication with said internal chamber of the box body and one outlet in communication with a delivery conduit having one end disposed in said base portion of the box body, before said opening of the base portion of the box body through which the fumes are extracted, a distributor disposed at the end of said delivery conduit; said distributor comprising an annular body with an internal surface with truncated-conical shape having an axis that coincides with the axis of the distributor, and deflector means disposed above said distributor in such a way to direct a delivery airflow from said delivery conduit towards at least one preferential direction with respect to the axis of the distributor, in such a way that at least two airflows with different flow rate come out from the distributor, wherein the airflow with the higher flow rate is directed towards a burner of said cooktop having a higher power than the other burners.

2. The hood of claim 1, wherein said distributor comprises a plurality of deflector fins that protrude from the internal surface of the annular body towards the inside of the distributor; said deflector fins being inclined by an angle different from zero with respect to a radial straight line passing through the axis distributor and a junction line of the deflector fin to the internal surface of the annular body of the distributor, in such a way to generate at least one vortex-shaped flow that rotates around the axis of the distributor, under the distributor and in front of the opening of the base portion of the box body through which the fumes are extracted; wherein said inclination angle of the deflector fins with respect to said radial straight line is comprised between 40° and 50°.

3. The hood of claim 1, wherein said deflector fins have a curved shape with a concave part and a convex part.

4. The hood of claim 1, wherein said deflector fins have an ending and a circumference passes by the ending edges of the deflector fins, said circumference having a center passing through the axis of said distributor.

5. The hood of claim 1, wherein said deflector means comprise a flange disposed above said distributor; said flange having an eccentric hole with an axis spaced by a spacing distance from the axis of the distributor.

6. The hood of claim 1, wherein said deflector means comprise a flange disposed above said distributor; said flange having a central hole with center on the axis of the distributor and said delivery conduit being mounted on said flange above said central hole of the flange; said delivery conduit having an axis inclined with respect to the axis of the distributor by an angle comprised between 10° and 50°.

7. The hood of claim 1, wherein said deflector means comprise:

a flange arranged above said distributor; said flange having a central hole with center on the axis of the distributor; and a deflector shaped as a plate mounted on the flange in proximity to the central hole; the deflector being disposed along a plane inclined with respect to the axis of the distributor by an angle comprised between 10° and 50°.

8. The hood of claim 2, wherein said distributor comprises a plurality of equally-spaced deflector fins, wherein each deflector fin is inclined with respect to said radial straight line by said angle that extends in clockwise direction from the radial straight lines to the deflector fin in such a way to obtain a vortex that comes out from the bottom of the distributor and rotates in clockwise direction around the axis of the distributor along a helicoidal trajectory.

9. The hood of claim 2, wherein said distributor comprises:

a first set of deflector fins that extend for half of the distributor circumference; and a second set of deflector fins disposed symmetrically to the deflector fins of the first set with respect to the distributor diameter, in such a way to obtain two vortexes that come out from the bottom of the distributor; the first vortex rotating in clockwise direction around the axis of the distributor along a helicoidal trajectory; the second vortex rotating in anticlockwise direction around the axis of the distributor along a helicolidal trajectory;

the distributor being disposed in the hood in such a way that the two vortexes meet in a position of the opening of the box body of the hood disposed behind the distributor.

10. The hood of claim 4, wherein said deflector means comprise a flange disposed above said distributor; said flange having an eccentric hole with an axis spaced by a spacing distance from the axis of the distributor.

11. The hood of claim 10, wherein said eccentric hole of the flange is circular and has a diameter that is lower than or identical to the diameter of said circumference passing by the ending edges of the deflector fins.

* * * * *